United States Patent [19]

Verducci

[11] 4,089,189

[45] May 16, 1978

[54] PIERCED EARRING WITH NON-ALLERGENIC PORTIONS FOR CONTACTING THE EAR

[76] Inventor: Henry A. Verducci, 52 Zella St., Providence, R.I. 02908

[21] Appl. No.: 799,752

[22] Filed: May 23, 1977

[51] Int. Cl.[2] ..... A44C 7/00

[52] U.S. Cl. ..... 63/12

[58] Field of Search ..... 63/12, 13

[56] References Cited

U.S. PATENT DOCUMENTS

| | | | |
|---|---|---|---|
| 161,853 | 4/1875 | Baker | 63/12 X |
| 320,991 | 6/1885 | Westcott | 63/12 UX |
| 1,419,021 | 6/1922 | Cicerchi | 63/12 |
| 3,122,007 | 2/1964 | Horland | 63/12 |
| 3,326,509 | 6/1967 | Kuttler | 85/36 X |
| 3,543,634 | 12/1970 | Allen | 85/36 |
| 3,605,438 | 9/1971 | Chalson | 63/12 X |

FOREIGN PATENT DOCUMENTS

| | | | |
|---|---|---|---|
| 759,383 | 10/1956 | United Kingdom | 63/13 |

*Primary Examiner*—F. Barry Shay
*Attorney, Agent, or Firm*—Salter & Michaelson

[57] ABSTRACT

A pierced earring construction is disclosed having an ornament formed of any suitable material and a post outwardly extending therefrom, which post is formed of or plated with a non-allergenic material and adapted for receipt in a pierced ear opening. A sleeve of generally disc-like configuration having an opening therein is adapted to be received by the post and positionable against the ornamental portion of the earring. The sleeve is also formed of a non-allergenic material and accordingly serves as a shield to prevent or reduce contact between the wearer's ear and adjacent portions of the ornament, and the connection, i.e., solder joint between the post and ornament. Additionally, the sleeve is adapted to frictionally engage the post so as to function as a fastener for connecting the post to the ornament in those cases wherein the post member is not integral with the ornament.

11 Claims, 7 Drawing Figures

PIERCED EARRING WITH NON-ALLERGENIC PORTIONS FOR CONTACTING THE EAR

BACKGROUND AND SUMMARY OF THE INVENTION

This invention relates to an earring construction which is especially adapted for engagement and suspension from a pierced ear opening through the earlobes of the wearer.

It is generally desirable with earring constructions of this type that those portions thereof coming in direct contact with the wearer's ear, or the pierced ear opening thereof, be formed of non-allergenic materials so as to reduce the possibility of resultant infections and the like. When the earrings, or at least those ear contacting portions thereof, are formed of metal, it is accordingly desirable to use such non-allergenic metals as gold, silver or stainless steel. The remaining portions of the earring, including ornamental and further supporting portions, may be formed of less costly or more workable metals including copper, bronze, nickel, steel or various other materials or alloys thereof which may be either used directly to form the ornament or as coatings to form various surface effects thereon. It is also common to attach posts to ornaments by means of solder connections. Skin contact with solder, especially nickel based formulation thereof, may cause skin rash, discoloration and infection. It would thus be desirable to shield those portions of an earring which are apt to be allergenic from contact with the wearer's ear, and particularly the pierced opening portions thereof.

Furthermore, when dissimilar metals are utilized in the formation of different portions of earring constructions, it is sometimes difficult to provide a satisfactory mutual attachment which is not overly expensive or timeconsuming. Thus it is known, for instance, to be difficult to attach a stainless steel post, as by soldering, to, for instance, a brass or copper ornament. It would accordingly be desirable to provide an attachment method which is not dependent on soldering, thus minimizing assembly time and costs, and at the same time, eliminating undesirable contact of the nickel content in solder with the wearer's ear, which contact frequently promotes an allergenic reation.

It is accordingly an object of the present invention to provide an earring construction of the aforementioned type in which a wearer's ears, and particularly the pierced opening portions thereof, are shielded from contact with those portions of the earring which may be formed of allergenic materials.

Another object of the present invention is the provision of an earring construction of the aforementioned type in which such shielding is accomplished by the positioning of a disc-like sleeve on the post of such earring construction so as to shield ear portions and particularly the pierced ear opening from contact with those portions of the earring ornament adjacent the post.

A still further object of the present invention is the provision of an earring construction having an ornamental portion from which a separate earring post outwardly extends in such a manner so as to be fixed in position therewith without the necessity of joining such portions by soldering, brazing, welding or other integral attachment techniques which may undesirably introduce allergenic materials to the earring construction.

These and other objects of the invention are accomplished by the provision of earring construction including an ear ornament formed of any suitable material and an earring post formed of a non-allergenic material and positioned with respect to the ornament so as to outwardly extend from a front generally planar surface portion thereof. The earring is further provided with a generally disc-shaped sleeve, also formed of a non-allergenic material, the sleeve being frictionally engaged to the post in a fixed longitudinally oriented attitude therewith so that portions thereof shield the planar portions of the ornament, including any solder joint thereat, from contact with portions of the wearer's ear, particularly the pierced ear opening thereof.

Other objects, features, and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
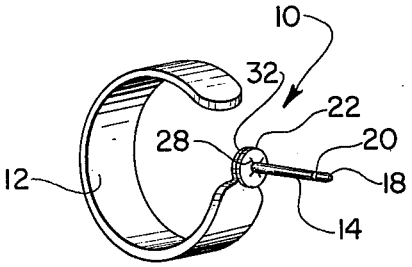
FIG. 1 is a perspective view of an earring construction illustrating a form of the present invention.
Figure 2:
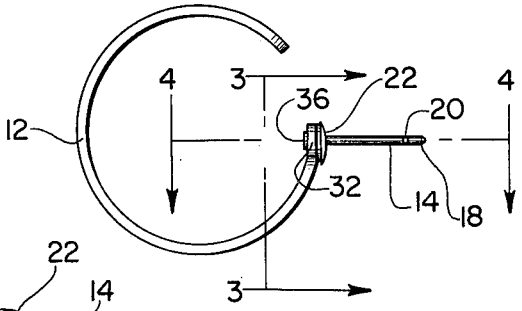
FIG. 2 is a side elevational view thereof.

Turning now to the drawings, and particularly FIGS. 1 through 5 thereof, one form of the invention is depicted. Therein an earring 10 is shown as having an ornament portion 12 and a post portion 14. The ornament 12 may take any desired configuration and furthermore may include additional ornamental parts suspended therefrom (not shown). The particular configuration shown is thus of a hooplike member which may have open portions if desired, and which by itself may form the entire ornamental portion of the earring 10 or may additionally support further ornamentation. The oranament 12 is formed from any suitable material but normally a copper base material, such as brass or bronze is used, which may be easily plated with various coating materials to produce a desired finish according to the style or dress mode to which the earring is tailored.

In order to position the earring 10 upon the ear of the wearer, the post 14 is provided, which post outwardly projects from the front of a generally planar portion 16 of the ornament 12 in such a manner so as to be receivingly engaged by the pierced ear opening of the wearer. The post is provided with a taper 18 at one end thereof and is adapted to pass through the pierced ear opening and project from the other side. A groove 20 for frictional receipt of a clutch member (not shown) is formed in the outer portion of the post so as to retain the earring on the wearer's ear, as is standard in the art.

Inasmuch as the post 14 intimately contacts the pierced ear opening, it is necessary that such be constructed of a material which is non-allergenic, i.e., will tend not to cause discoloration, infection, rash and the like when contacting those portions of the wearer's ear. Suitable metallic materials commonly utilized for this purpose include gold, silver and surgical or stainless steel. It may further be apparent that when positioned upon the ear of the wearer, the earring 10 may present portions of the ornament 12 thereof, especially those planar portions 16, into position for contact with ear portions of the wearer, particularly those areas proximate the pierced ear opening. In order to shield those portions of the wearer's ear from contact with the ornament 12, a sleeve 22 generally of disc-like configuration and having a generally centrally disposed opening 24 therein is positioned proximate the planar area 16 of the ornament 12 in the manner shown, i.e., by the receipt of the post 14 within the opening of 24 thereof. The term disc or disc-like is utilized herein in a broad sense and accordingly the sleeve is not limited to circular configuration but may also include oval, square, rectangular or irregular shapes tailored to a particular earring design.

The sleeve is further provided with a plurality of segments 26 formed by slits 28 outwardly radiating from the periphery of the opening 24 so as to enable such segments to outwardly flex as they are pushed along the post 14 while in frictional contact therewith. Also, in order to assure the proper longitudinal positioning of the sleeve 22 relative to the post 14, and in turn to the ornament 12, a groove 30, proximate but spaced from the other end of the post 14, is provided into which the segments 26 may become anchored. As will be noted, the disc is gently bowed so as to extend inwardly towards and preferably in contact with peripheral areas of the planar portion 16 so as to effectively mask that portion of the ornament 12 from ear contact. Inasmuch as the sleeve 22 is also formed of non-allergenic material, its direct contact with portions of the wearer's earlobe will cause no adverse allergenic reactions, and thus effectively serves to mask or to prevent contact with the ornament 12.

Figure 3:
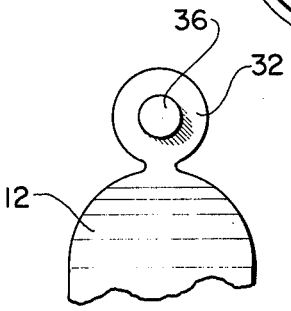
FIG. 3 is a partial rear view thereof on an enlarged scale taken along the line 3—3 of FIG. 2.
Figure 4:
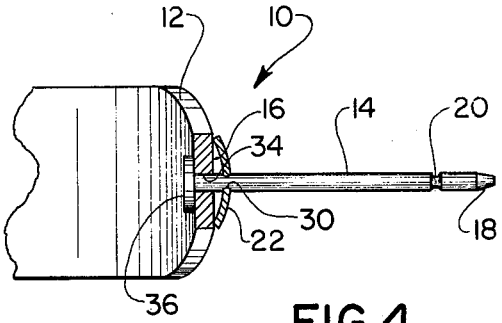
FIG. 4 is a view partially in section taken along the line 4—4 of FIG. 2.

Also, and as best depicted in FIG. 3 of the drawing, the planar area 16 may generally take the form of an eyelet 32 having an opening 34 therethrough. The opening is adapted to receive the post as by the threading of the post 14 therethrough until a headed portion 36 provided at the other end of the post rests against or otherwise abuttingly contacts rear portions of the planar portion 16. Thereafter the sleeve 22 is threaded over the post and positioned within the groove 30. It should be clear that such configuration is particularly useful when the post 14 is formed of a material dissimilar from that forming the ornament 12 and wherein the two parts are accordingly separate, i.e., non-integral. In such construction, the mutual abutment of the sleeve 22 against the ornament at its peripheral portions and against the post at its interior portions as by engagement of the segments 26 within the groove 30 serves to longitudinally fix the position of the post 14 with respect to the ornament 12, and in this way interconnects such earring components without necessity of separate time-consuming and often undesirable secondary operations, such as welding, soldering, brazing and the like.

Figure 6:
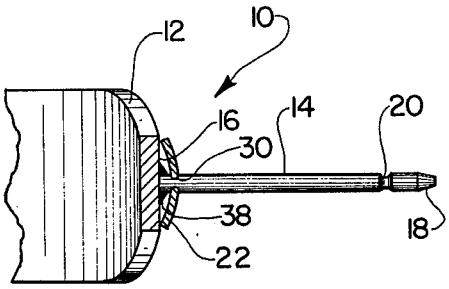
FIG. 6 is a view similar to FIG. 4 but showing a modified form of the invention wherein the post is integrally attached to the ornament, as by soldering techniques.
Figure 5:
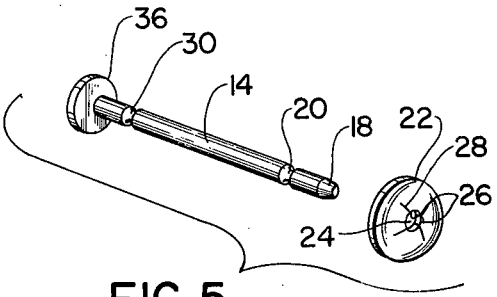
FIG. 5 is an exploded perspective view of the post and sleeve portions of the present earring construction showing their assembly relationship.

Turning now to FIG. 6 of the drawing, a modified embodiment of the invention is shown wherein the post 14 is connected to the planar portion 16 of the ornament 12 by conventional means such as soldering, welding, brazing and the like. In such embodiment, the attachment mechanisms above discussed serve to longitudinally fix the position of the post 14 with respect to the ornament, and accordingly no opening corresponding to opening 34 in the embodiment discussed with relationship to FIGS. 1 through 5 of the drawing, or the provision of a head 36 on the post for abutment to rear portions of the planar surface 16 is required. However, the sleeve 22 in such construction not only effectively shields ear portions of the wearer from contact with the ornament 12 at least those planar portions 16 thereof, but furthermore shields such from contact with connecting beads, fillets and the like present by reason of the solder, brazing or welding steps utilized to interconnect the post 14 with the ornament 12. This shielding action is particularly desirable when the connecting materials utilized, i.e., solder, contain allergenic components such as nickel. It should also be noted that the sleeve 22 preferably assumes an overall somewhat domelike configuration in line with the ability of its individual segments 26 to outwardly flex while being forced along the post towards the ornament and by its interengagement with the groove 30 disposed in a position slightly spaced from surface 16. This configuration not only provides for a smooth transition between the members 12 and 14, but furthermore provides necessary accommodating space for attachment fillets or beads 38.

Figure 7:
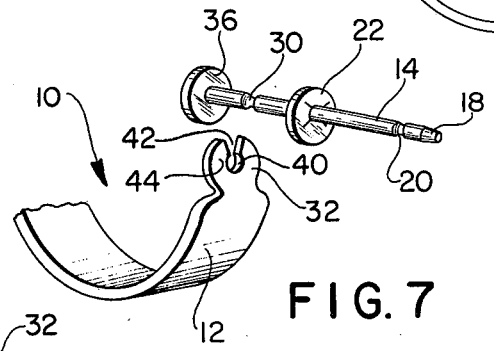
FIG. 7 is a partial perspective view of another form of the invention wherein the post is attached to the ornament by means of a key hole slot provided therein.

Turning now to FIG. 7 of the drawing, a further modified embodiment of the invention is shown wherein the post 14 is connected to the ornament by means of a frictional interrelation between the post and ornament. Therein a post 14 constructed as that described in relationship with FIGS. 1–5 is provided for snap fitting frictional engagement into an opening 40 within the planar portion of eyelet 32. A key hole shaped slot 42 leads from the periphery of the eyelet into the opening 40 and is defined by opposed eyelet segments 44. The width of the slot at its connection with the opening may be slightly less than the diameter of the post so that the segments 44 are expanded to snap-receive the post within the opening 40. In this embodiment there is no need to initially thread the post through the opening as with the closed opening 34 in the embodiment shown by FIGS. 1–5 since the post, once aligned with the ornament in its proper position, is merely forced into the opening. Such snap fit engagement also enables the sleeve 22 to be prepositioned on the post as shown in FIG. 7 by automatic equipment, rather than by hand. After the ornament and post are engaged, the sleeve 22 is then, as in the FIGS. 1–5 embodiment, forced along the post 14 until it interengages within the groove 30 so as to assure a finished construction (not shown) essentially similar to that shown in FIG. 4 with the post projecting out of the ornament and the enlarged head or flange 36 abutting rear portions thereof. In such position the sleeve 22 is generally adjacent to the ornament face so as to provide the desired shielding effect of the wearer's ear from the ornament which, as in the previous embodiments, may be formed of allergenic materials. It has been found that by utilizing the assembly techniques illustrated in FIG. 7, time consuming and costly hand assembly operations are minimized since it is no longer necessary to thread the post 14 through opening 40 or to thread the sleeve 22 on to post 14, as the latter operation may now be automatically performed.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An earring construction including an ear ornament formed of any suitable material and an earring post attached thereto and having one end thereof adapted for receipt into and through the pierced ear opening of a wearer for support of said earring therefrom, said post formed of a non-allergenic material and positioned with respect to said ornament so as to outwardly extend from a generally planar portion thereof, means for preventing said ornament from contacting the ear lobe during wear, including a sleeve separate from said ornament and not forming a part thereof, said sleeve being generally disc shaped and also formed of a non-allergenic material and having a generally centrally disposed opening for receipt of said post and friction means for engaging said post, said sleeve positioning on said post proximate said planar portion of said ornament, portions of said sleeve extending towards peripheral portions of said ear ornament planar portion, said sleeve of an overall dimension being no greater than said planar portion of said ornament such that said planar portion substantially conceals such sleeve from view; said sleeve adapted to be disposed between said ornament and those portions of the wearer's ear adapted for positioning adjacent thereto so as to effectively shield such planar portion, which is not necessarily formed of non-allergenic materials, from contact with such ear portions.

2. The earring of claim 1, said ornament generally planar portion having an opening therethrough, said post having an enlarged head at the other end thereof, said post positioned within said opening with said head contacting rear portions of said planar portion, said sleeve frictionally engaging said post so as to connect said post to said ornament.

3. The earring of claim 2, said friction means including a plurality of outwardly deflectable segments defining said sleeve opening, said segments received within a peripheral groove disposed in said post, said groove positioned proximate said planar portion.

4. The earring of claim 1, said sleeve of an overall domed configuration having central portions of said sleeve disposed proximate but spaced from said planar portion, peripheral portions of said sleeve extending inwardly towards said planar portion.

5. The earring of claim 4, said post integrally soldered to the front face of said planar portion of said ornament generally centrally thereof, said sleeve disposed between the resultant solder fillet and those portions of the wearer's ear adapted for disposition adjacent said ornament.

6. The earring of claim 4, said ornament generally planar portion having an opening therethrough, said post having an enlarged head at the other end thereof, said post positioned within said opening with said head contacting rear portions of said planar portion, said sleeve frictionally engaging said post so as to connect said post to said ornament.

7. The earring of claim 2, said ornament opening being a closed opening, said post threadably received through said opening until said enlarged head contacts said planar portion.

8. The earring of claim 2, said generally planar portion having a peripheral slot connecting with said opening and forming an entrance whereby said post is adapted for receipt into said opening for connecting said post and ornament together.

9. The earring of claim 8, said sleeve of an overall domed configuration having central portions of said sleeve disposed proximate but spaced from said planar portion, peripheral portions of said sleeve extending inwardly towards said planar portion.

10. The earring of claim 8, said slot diverging from its outer to its inner end, the width of said slot at its outer end being greater than the diameter of said post, and at its inner end being slightly less than said diameter, whereby said post may be forced into said opening and snap-received therein.

11. An earring construction including an ear ornament formed of any suitable material and an earring post attached thereto and having one end thereof adapted for receipt into and through the pierced ear opening of a wearer for support of said earring therefrom, said post formed of a non-allergenic material and positioned with respect to said ornament so as to outwardly extend from a generally planar portion thereof, means for preventing said ornament from contacting the ear lobe during wear, including a sleeve separate from said ornament and not forming a part thereof, said sleeve being generally disc shaped and also formed of a non-allergenic material and having a generally centrally disposed opening for receipt of said post and friction means for engaging said post, said sleeve positioned on said post proximate said planar portion of said ornament, portions of said sleeve extending towards peripheral portions of said ear ornament planar portion; said sleeve adapted to be disposed between said ornament and those portions of the wearer's ear adapted for positioning adjacent thereto so as to effectively shield such planar portion, which is not necessarily formed of non-allergenic materials, from contact with such ear portions, said friction means including a plurality of deflectable segments defining said sleeve opening, said segments received within a peripheral groove disposed in said post, said groove positioned proximate said planar portion.

* * * * *